US012663196B2

(12) United States Patent
Bolek et al.

(10) Patent No.: US 12,663,196 B2
(45) Date of Patent: Jun. 23, 2026

(54) AIR GUIDE FOR A REFRIGERATOR APPLIANCE

(71) Applicant: Haier US Appliance Solutions, Inc., Wilmington, DE (US)

(72) Inventors: Slawomir Pawel Bolek, Goshen, KY (US); Saravanan Rajamanickam, Louisville, KY (US); David Gantt, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 284 days.

(21) Appl. No.: 18/319,642

(22) Filed: May 18, 2023

(65) Prior Publication Data

US 2024/0384919 A1 Nov. 21, 2024

(51) Int. Cl.

| | |
|---|---|
| ***F25D 17/06*** | (2006.01) |
| ***F25C 1/24*** | (2018.01) |
| ***F25D 27/00*** | (2006.01) |

(52) U.S. Cl.

CPC ..... *F25D 17/062* (2013.01); *F25C 1/24* (2013.01); *F25D 27/00* (2013.01); *F25D 2317/061* (2013.01)

(58) Field of Classification Search

CPC .. F25D 17/062; F25D 27/00; F25D 2317/061; F25D 2317/063; F25D 2317/0665; F25C 1/24

See application file for complete search history.

(56) References Cited

U.S. PATENT DOCUMENTS

| | | | |
|---|---|---|---|
| 10,634,418 | B2 | 4/2020 | Bae et al. |
| 10,976,091 | B2 | 4/2021 | Kim |
| 11,402,146 | B2 | 8/2022 | Jeon et al. |
| 2019/0145686 | A1 | 5/2019 | Kim |
| 2019/0277557 | A1 | 9/2019 | Khekale |
| 2021/0095910 | A1 | 4/2021 | Jeon et al. |
| 2021/0199364 | A1 | 7/2021 | Kim |

FOREIGN PATENT DOCUMENTS

| | | | |
|---|---|---|---|
| JP | H09210531 | A | 8/1997 |
| JP | 3389400 | B2 | 3/2003 |
| WO | WO2017190807 | A1 | 11/2017 |
| WO | WO2021187742 | A1 | 9/2021 |

*Primary Examiner* — Cassey D Bauer
(74) *Attorney, Agent, or Firm* — Dority & Manning, P.A.

(57) ABSTRACT

A refrigerator appliance may include a freezer chamber having a freezer door rotatably mounted thereto. The freezer chamber may include an inner liner having a top freezer wall that defines one or more air channels. In addition, the refrigerator appliance may include an ice making assembly positioned at the freezer door. Furthermore, the refrigerator appliance may include one or more air guides that protrude into the freezer chamber from the top freezer wall. The refrigerator appliance may also include a light assembly attached to the top freezer wall. The light assembly may include a light source and a light lens that covers the light source.

11 Claims, 8 Drawing Sheets

AIR GUIDE FOR A REFRIGERATOR APPLIANCE

FIELD

The present disclosure relates to refrigerator appliances, and more particularly to air guides for guiding cooled air to an ice maker of such appliances.

BACKGROUND

Certain refrigerator appliances may include an ice maker. To produce ice, liquid water is directed to the ice maker and frozen. For example, certain ice makers include a mold body for receiving liquid water. In some systems, a working fluid is used to directly cool the mold body, e.g., by conductive heat transfer as opposed to cooling the air around the mold body, to form ice. After ice is formed in the mold body, it may be harvested from the mold body and stored within an ice bin or bucket within the refrigerator appliance.

In some systems, additional cooling, such as indirect cooling of the ice maker may be included. For instance, the ice maker may be ambiently exposed to cooled air within the refrigerator appliance, e.g., to indirectly cool the ice maker. However, internal space within the refrigerator appliance may be limited and, in some instances, cooled air may be blocked from indirectly cooling the ice maker.

Accordingly, a refrigerator appliance with features for guiding a flow of cooled air to the ice maker while also minimizing a potential for obstructed air flow communication to the ice maker would be desirable.

BRIEF DESCRIPTION OF THE DRAWINGS

A full and enabling disclosure of the present disclosure, including the best mode thereof, directed to one of ordinary skill in the art, is set forth in the specification, which makes reference to the appended figures.

DETAILED DESCRIPTION

Figure 1:
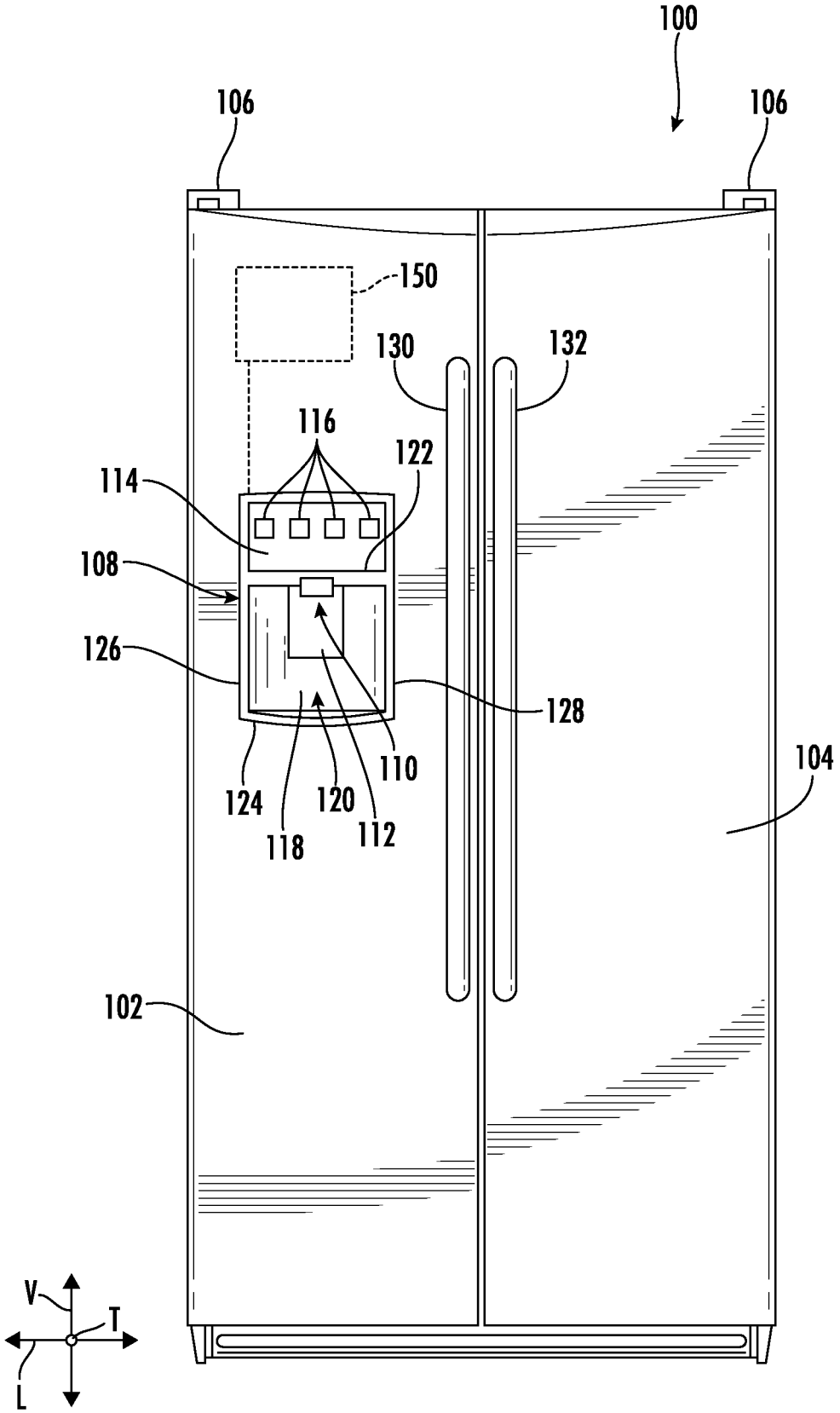
FIG. 1 provides a front view of a refrigerator appliance according to one or more exemplary aspects of the present subject matter.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

Approximating language, as used herein throughout the specification and claims, may be applied to modify any quantitative representation that could permissibly vary without resulting in a change in the basic function to which it is related. Accordingly, a value modified by a term or terms, such as "generally," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "approximately vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both").

The singular forms "a," "an," and "the" include plural references unless the context clearly dictates otherwise.

Referring now to the drawings, wherein identical numerals indicate the same elements throughout the figures, FIG. 1 provides a front view of an exemplary refrigerator appliance 100 according to one or more exemplary aspects of the present subject matter. The refrigerator appliance 100 may generally define a vertical direction V, a lateral direction L, and a transverse direction T, each of which is mutually perpendicular with every other, such that an orthogonal coordinate system is generally defined. It should be appreciated that the refrigerator appliance 100 of FIG. 1 is for illustrative purposes only and that the present subject matter is not limited to any particular type, style, or configuration of refrigerator appliance, and that such appliance may include any manner of refrigerator, freezer, refrigerator/freezer combination, and so forth.

The refrigerator appliance 100 may include a freezer door 102 and a fresh food door 104. The freezer door 102 and the fresh food door 104 may each be rotatably mounted to the refrigerator appliance 100 such that each may selectively move between an open position and a closed position. The freezer door 102 may include a handle 130 and the fresh food door 104 may include a handle 132. The handle 130 and the handle 132 may each be used to move the respective door between the closed position (see e.g., FIG. 1) and the open position (see e.g., FIG. 2). Furthermore, the freezer door 102 and the fresh food door 104 may each be mounted to a top hinge 106 and a bottom hinge (not shown) that together may be configured to rotate the respective door around the outer vertical edge of the door, e.g., between the open position and the closed position.

Further, the refrigerator appliance 100 may include a dispenser assembly 108 for dispensing liquid water and/or ice. In some embodiments, the dispenser assembly 108 may be positioned on or mounted to an exterior portion of the refrigerator appliance 100, such as on the freezer door 102. The dispenser assembly 108 may include a discharging outlet 110 configured to discharge ice and/or liquid water. An actuating mechanism 112, shown as a paddle, may be mounted below discharging outlet 110 for operating the dispenser assembly 108.

In alternative exemplary embodiments, another suitable actuator may be used to operate dispenser assembly 108. For example, dispenser assembly 108 can include a sensor (such as an ultrasonic sensor) or a button rather than the paddle. A user interface panel 114 is provided for controlling the mode of operation. For example, user interface panel 114 may include a plurality of user inputs 116, such as a water dispensing button and an ice-dispensing button, for selecting a desired mode of operation such as crushed or non-crushed ice.

In some embodiments, such as FIG. 1, the discharging outlet 110 and actuating mechanism 112 may be an external part of dispenser assembly 108 and are mounted in a dispenser recess 118. Generally, dispenser recess 118 defines a transverse opening 120 that extends in the vertical direction V from a top recess end 122 to a bottom recess end 124, as well as in the lateral direction L from a first recess side 126 to a second recess side 128. In certain embodiments, dispenser recess 118 may be positioned at a predetermined elevation that may be convenient for a user to access ice or water and enabling the user to access ice without the need to bend-over and without the need to open doors 102, 104. In optional embodiments, dispenser recess 118 may be positioned at a level that may approximate the chest level of a user.

Generally, operation of the refrigerator appliance 100 can be regulated by a controller 150 that is operatively coupled to user interface panel 114 or various other components, as will be described below. User interface panel 114 provides selections for user manipulation of the operation of refrigerator appliance 100, such as selections between whole or crushed ice, chilled water, or other various options. In response to user manipulation of user interface panel 114 or one or more sensor signals, controller 150 may operate various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

The controller 150 may be positioned in a variety of locations throughout refrigerator appliance 100. For instance, the controller 150 may be located adjacent to or on user interface panel 114. In other embodiments, controller 150 may be positioned at another suitable location within refrigerator appliance 100, for example, within the freezer door 102, within the fresh food door 104, within a chamber of the refrigerator appliance 100, etc. Input/output ("I/O") signals may be routed between controller 150 and various operational components of refrigerator appliance 100. For example, user interface panel 114 may be in operable communication (e.g., electrical communication) with controller 150 via one or more signal lines or shared communication busses.

The controller 150 may be operatively coupled with the various components of dispenser assembly 108 and may control operation of the various components. For example, the various valves, switches, etc. may be actuatable based on commands from controller 150. As discussed, user interface panel 114 may additionally be operatively coupled (e.g., via electrical or wireless communication) with controller 150. Thus, the various operations may occur based on user input or automatically through controller 150 instruction.

Figure 2:
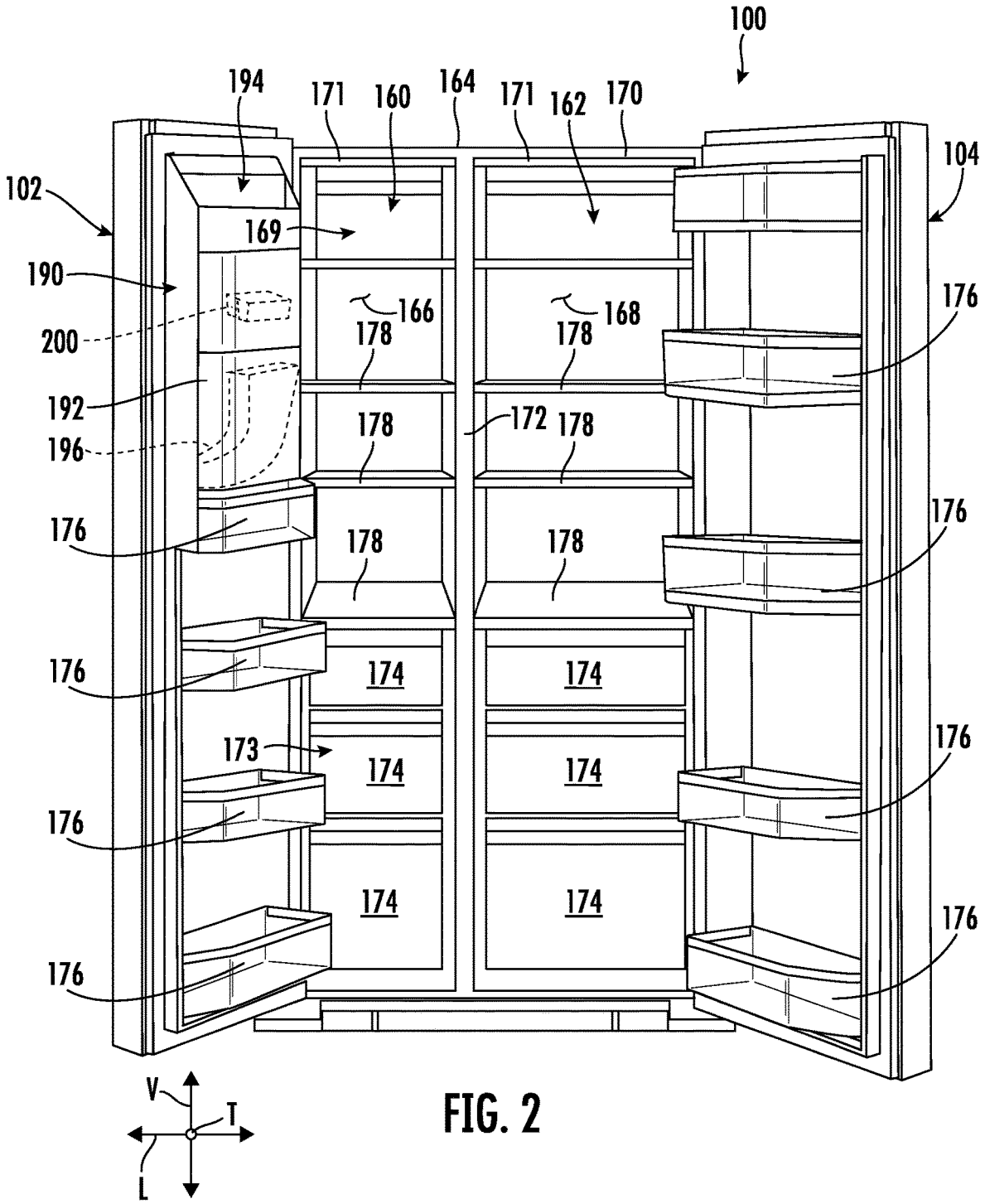
FIG. 2 provides a front view of the refrigerator appliance of FIG. 1 with doors thereof in an open position.

FIG. 2 provides a perspective view of the refrigerator appliance 100 having the freezer door 102 and the fresh food door 104 in the open position to reveal a freezer chamber 160 and a fresh food chamber 162, respectively. The freezer chamber 160 and the fresh food chamber 162 may be arranged side-by-side and contained within an outer case 164 and inner liners 166 and 168 generally molded from a suitable plastic material. The outer case 164 may be formed by folding a sheet of a suitable material, such as a pre-painted steel into an inverted U-shape to form top and side walls of the outer case 164. In some instances, a bottom wall of the outer case 164 may be formed separately and attached to the case side walls and to a bottom frame that provides support for the refrigerator appliance 100.

A breaker strip 170 may extend between a case front flange and outer front edges 171 of inner liners 166 and 168. The breaker strip 170 may be formed from a suitable resilient material, such as an extruded acrylo-butadiene-styrene based material (commonly referred to as ABS). The insulation in the space between inner liners 166 and 168 is covered by another strip of suitable resilient material, which also commonly is referred to as a mullion 172 and may be formed of an extruded ABS material. The breaker strip 170 and the mullion 172 may form a front face, and extend completely around inner peripheral edges of the outer case 164 and vertically between inner liners 166 and 168. In some embodiments, the freezer chamber 160 and the fresh food chamber 162 may include slide-out drawers 174, storage bins 176 and shelves 178 to support items being stored therein.

In addition, in some embodiments, the freezer chamber 160 may define a top portion 169 and a bottom portion 173. The top portion 169 of the freezer chamber 160 may correspond to approximately the top fifty percent of the vertical space of the freezer chamber 160. The bottom portion 173 of the freezer chamber 160 may correspond to approximately the bottom fifty percent of the vertical space of the freezer chamber 160.

Further, the refrigerator appliance 100 may include an ice making assembly 190 positioned at, or on the inside of, the freezer door 102. The ice making assembly 190 may be formed integrally with the freezer door 102 or may be coupled to the freezer door 102, such as the ice making assembly 190 may be attached to the inside of the freezer door 102. The ice making assembly 190 may include an ice making chamber 192 that may house an ice maker 200 and may include a guided cooled air inlet 194 defined at the top edge, e.g., along the vertical direction V, of the ice making chamber 192. The ice making chamber 192 may further house a chute 196 (depicted in phantom) that may guide harvested ice to a user, e.g., via dispenser assembly 108. When the freezer door 102 is in the closed position, the ice maker 200 may be ambiently exposed within the freezer chamber 160, such as via the guided cooled air inlet 194. In other words, the ice maker 200 may not be insulated from the ambient air within the freezer chamber 160 when the freezer door 102 is in the closed position. More specifically, individual parts of the ice maker 200 (which will be described below with reference to FIG. 3), such as a mold body 210, may be exposed within the freezer chamber 160. As will be described in more detail below, the ice making chamber 192 may be configured to receive a flow of cooled air produced by a sealed cooling system (see e.g., FIG. 5), to cool the ice making chamber 192, and more particularly components housed within the ice making chamber 192, e.g., the ice maker, an ice bin, etc.

Figure 3:
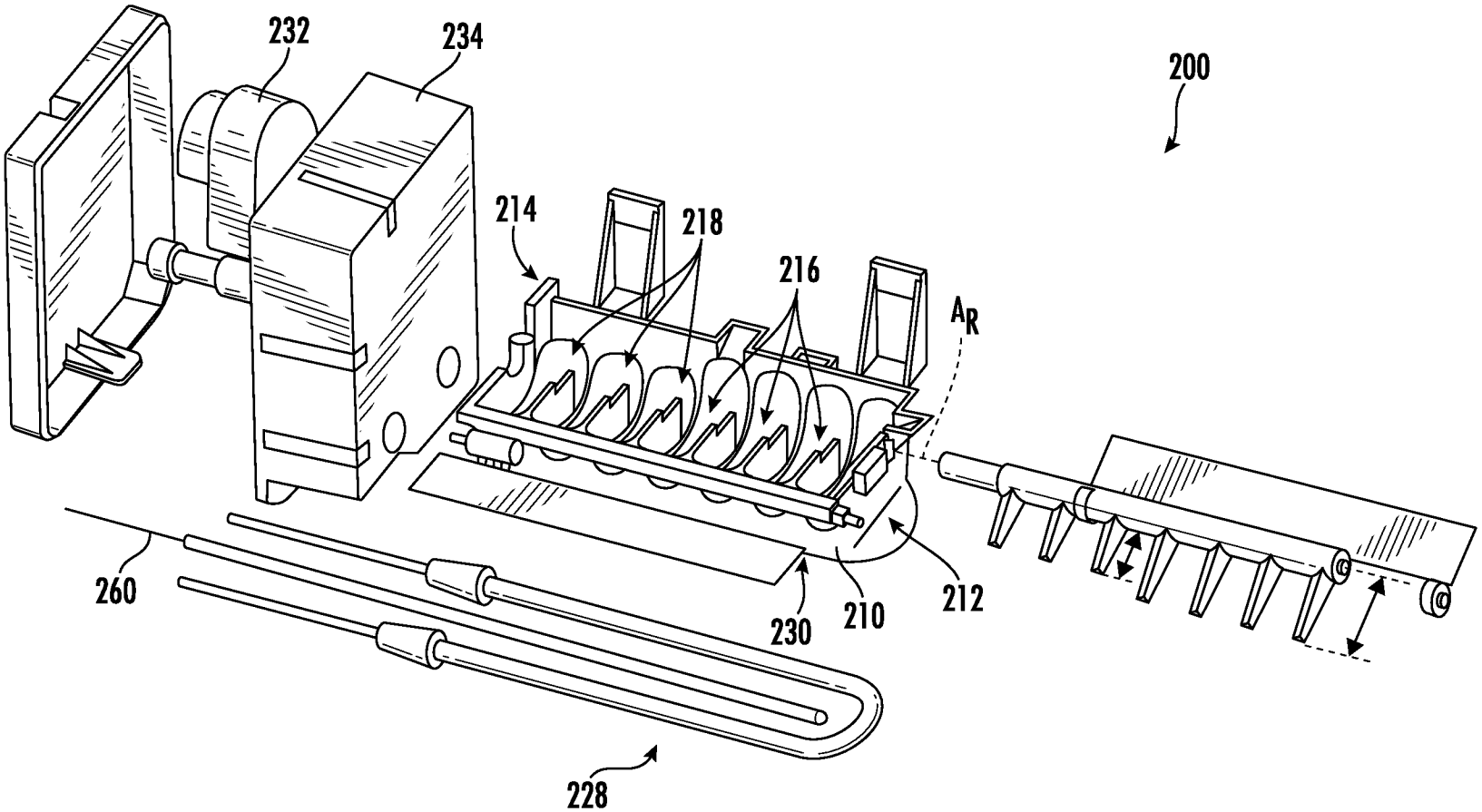
FIG. 3 provides an exploded perspective view of an ice maker which may be incorporated into a refrigerator appliance, such as the exemplary refrigerator appliance of FIG. 1 according to one or more exemplary aspects of the present subject matter.

FIG. 3 provides an exploded perspective view of the ice maker 200 of the refrigerator appliance 100 according to one or more exemplary aspects of the present subject matter. Generally, the ice maker 200 may include an ice mold or mold body 210 that may extends between a first end portion 212 and a second end portion 214. e.g., along a rotation axis $A_R$. The mold body 210 may define multiple compartments, e.g., one or more first compartments 216 and one or more second compartments 218, separated by one or more partitions walls for receipt of liquid water for freezing. The compartments 216, 218 may be spaced apart from one another or distributed, e.g., along the rotation axis $A_R$ between first end portion 212 and second end portion 214. Thus, a partition wall may be axially positioned between a first compartment 216 and a second compartment 218.

In some embodiments, the ice maker 200 may receive liquid water, e.g., from a water connection to plumbing within a residence or business housing refrigerator appliance 100, and direct such liquid water into mold body 210, e.g., into compartments 216, 218 of mold body 210. Within compartments 216, 218 of mold body 210, liquid may freeze to form ice cubes. It is understood that the term "ice cube," as used herein, does not require a cubic geometry, i.e., six bounded square faces, but indicates a discrete unit of solid frozen ice generally having a predetermined three-dimensional shape.

As shown, a refrigerant line or refrigerant conduit 228 may run through ice maker 200. For example, refrigerant line 228 may be part of a sealed system or sealed cooling system 400 described below. Accordingly, refrigerant cooled to a temperature below freezing may be cycled through the ice maker 200 to produce the ice cubes. In some embodiments, the ice maker 200 may further include a heating element or heater 260 mounted to a lower portion 230 of mold body 210. The heater 260 may be press-fit, stacked, or clamped into the lower portion 230 of the mold body 210. The heater 260 may heat the ice maker 200 after a harvest cycle is performed. Alternatively, the heater 260 may heat the ice maker 200 when frost is detected on the ice maker 200. In some embodiments, the heater 260 may heat the ice maker 200 during periods of non-use (e.g., when an ice storage compartment is full). In some embodiments, the heater 260 may heat the ice maker 200 to assist in releasing ice cubes from the compartments 216, 218 of the mold body 210.

Figure 4:
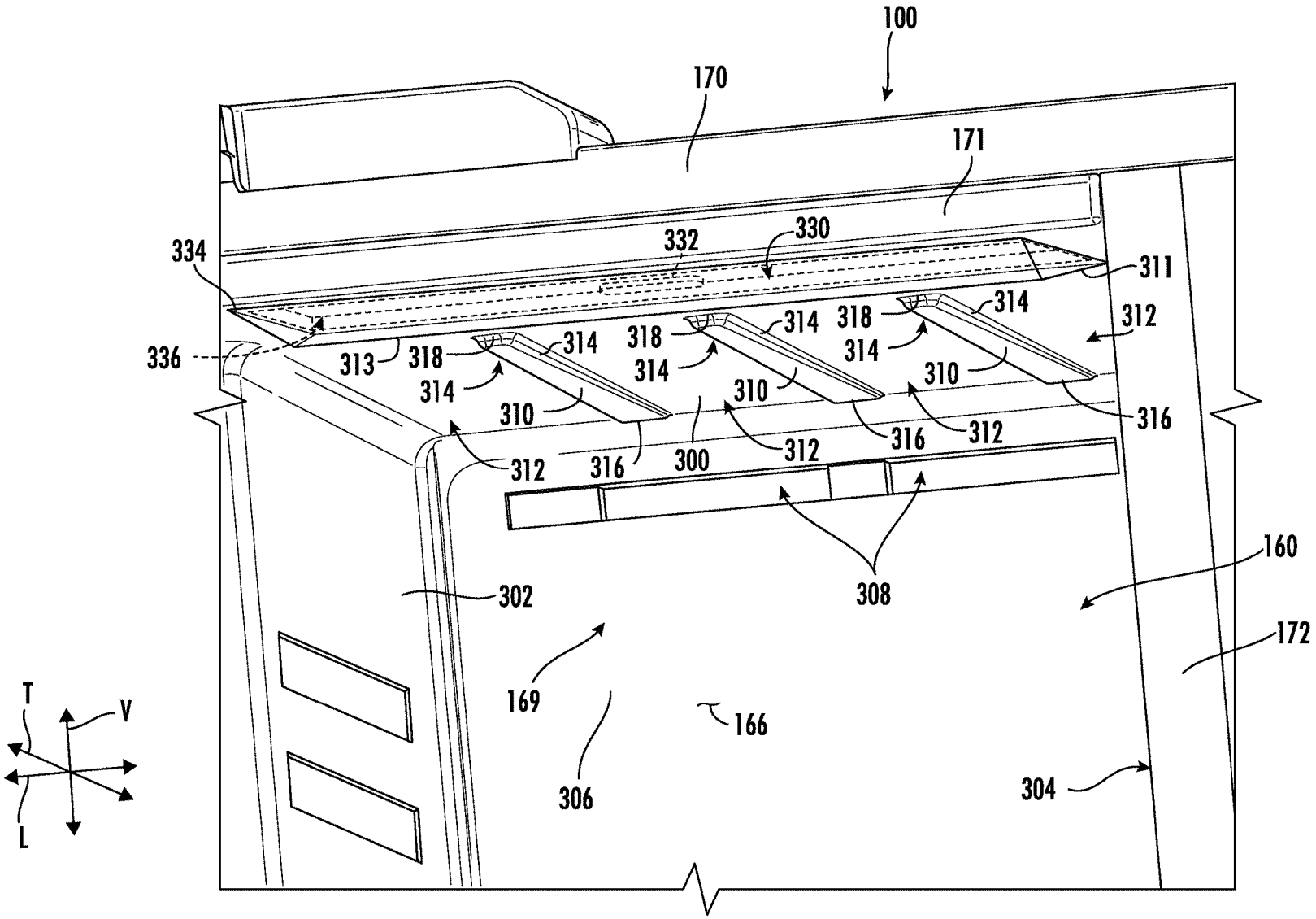
FIG. 4 provides a perspective view of a top portion of a freezer chamber of the refrigerator appliance of FIG. 1 according to one or more exemplary aspects of the present subject matter.

FIG. 4 provides a perspective view of a top portion 169 of the freezer chamber 160 according to one or more exemplary aspects of the present subject matter. In some embodiments, the molded inner liner 166 of the freezer chamber 160 may extend between a top freezer wall 300 and a bottom freezer wall (not depicted) approximately along the vertical direction V. In addition, the inner liner 166 may extend between a first side freezer wall 302 (e.g., the left freezer wall when viewed from the front as in FIGS. 1 and 2) and a second freezer wall 304 (e.g., the right freezer wall when viewed from the front as in FIGS. 1 and 2) approximately along the lateral direction L, and between an outer front edge 171 and a back freezer wall 306 approximately along the transverse direction T. In general, terms such as "left," "right," "front," "back," "top," or "bottom" are used with reference to the perspective of a user accessing the refrigerator appliance 100, e.g., standing at or near one or both doors 102, 104 to reach into one or both chambers 160, 162.

The back freezer wall 306 may include one or more ports 308 that are defined through the back freezer wall 306. In some embodiments, the one or more ports 308 may be positioned proximate the top freezer wall 300, such as within the top portion 169 of the freezer chamber 160. Moreover, in some embodiments, the one or more ports 308 may be positioned within the top twenty five percent of the vertical height of the back freezer wall 306. In addition, the one or more ports 308 may fluidly couple the top portion of the freezer chamber 160 to a cooled air passage 508 (see e.g., FIG. 6) that may be located behind the back freezer wall 306.

As will be understood by those skilled in the art, the number of ports 308 depicted is provided by way of example only. In additional embodiments, any suitable number of ports 308 may be defined through the back freezer wall 306. For example, in some embodiments, only one port 308 may be provided, or more than two ports 308 may be provided, such as three or more ports 308.

The top freezer wall 300 may include one or more air guides 310 that each protrude, e.g., extend vertically downward, into the freezer chamber 160 from the top freezer wall 300. In some embodiments, the one or more air guides 310 may be formed integrally into the top freezer wall 300, e.g., they may be formed integrally into the inner liner 166, such as being portions of the inner liner 166 that extend vertically downward beyond the main surface of the top freezer wall 300, e.g., into the freezer chamber 160. In some instances, the one or more air guides 310 may be the only feature of the top freezer wall 300 that may protrude into the freezer chamber 160. Moreover, the sections of the top freezer wall 300 that do not protrude into the freezer chamber 160, such as air channels 312 (described in more detail below) may maintain a relatively flat profile, e.g., the sections of the top freezer wall 300 that do not protrude into the freezer chamber 160 may be approximately on the same plane, such as in or approximately parallel to a lateral-transverse plane defined by the lateral direction L and the transverse direction T.

In addition, each air guide 310 may extend from a first end to a second end. As described herein and as depicted the first end of each air guide 310 may be located at the back freezer wall 306. Therefore, in some embodiments the first end of each air guide 310 may be a back end 316 of each air guide 310. Further, the second end of each air guide 310 may be located proximate to the outer front edge 171. Therefore, in some embodiments, the second end of each air guide 310 may be a front end 318 of the air guide 310.

However, it should be appreciated that in alternative embodiments, the first end of each air guide 310 may be located proximate to the outer front edge 171. Therefore, in some embodiments, the first end of each air guide 310 may be the front end 318 of each air guide 310. Further, the second end of each air guide 310 may be located at the back freezer wall 306. Therefore, in some embodiments, the second end of each air guide 310 may be the back end 316 of each air guide 310.

In some embodiments, the back end 316 of each air guide 310 may be positioned approximately at an intersection of the top freezer wall 300 and the back freezer wall 306, wherein "approximately at an intersection" may refer to a position that may be transversely offset from the back freezer wall 306 by no more than ten percent of the depth of the freezer chamber 160. Further, in some embodiments, such as FIG. 4, each air guide 310 may be tapered such that the vertical depth, e.g., the vertical downward extension, of the respective air guide 310 may gradually increase at a constant back-to-front slope, such as gradually increasing from the first end to the second end of each air guide 310 e.g., gradually increasing from the back end 316 of the respective air guide 310 to the front end 318 of the respective air guide 310. For instance, each air guide 310 of FIG. 4 may be approximately flush with, e.g., even with, the top freezer wall 300 at the back end 316 of the air guide 310 and the vertical depth of the air guide 310 may increase at a constant slope such that the maximum vertical depth of the air guide 310 may correspond to the front end 318 of the air guide 310.

In additional embodiments, each air guide 310 may protrude into the freezer chamber 160 from the top freezer wall 300 at a unique vertical depth, e.g., each air guide 310 may extend vertically downward into the freezer chamber 160 at a unique distance. For example, in some embodiments, the left most air guide 310 may extend vertically downward a greater distance than the right most air guide 310. As another example, in some embodiments, the air guide 310 closest to the center of the top freezer wall 300 may extend vertically downward a greater distance than the left most and the right most air guides 310.

In addition, the one or more air guides 310 may define one or more air channels 312 at the top freezer wall 300. For instance, the one or more air guides 310 each may be spaced laterally apart along the top freezer wall 300 to define the one or more air channels 312 at the top freezer wall 300. Particularly, lateral sides 314 of each air guide 310 may, at least in part, define the cold air channels 312. For example, the cold air channels 312 may be defined laterally between adjacent air guides 310, such as laterally between adjacent lateral sides 314 of adjacent air guides 310, laterally between the left most air guide 310 and the left freezer wall 302, or laterally between the right most air guide 310 and the right freezer wall 304. The one or more air channels 312 may extend transversely from the back freezer wall 306 to the outer front edge 171, e.g., along the top freezer wall 300. In addition, the one or more air channels 312 may be positioned at the top freezer wall 300, such as at the non-protruded portions of the top freezer wall 300.

Further, the protruded air guide(s) 310 may serve to prevent, or mitigate obstructions that may enter a flow path created by the one or more air channels 312. For instance, the vertical downward extension of the one or more air guides 310 may prevent a user from positioning an object, e.g., food or other items that may be typically placed in the freezer chamber 160, in the flow path of the one or more air channels 312. In addition, the lateral spacing of the air guide(s) may be prevent, or mitigate, the potential for obstruction in the flow paths created by the one or more air channels 312 as objects that may be typically placed in the freezer chamber 160 may not fit in the space between the air guide(s) 310, e.g., the one or more air channels 312.

As will be understood by those skilled in the art, the number of air guides 310 depicted is provided by way of example only. In additional embodiments, any suitable number of air guides 310 may be provided at the top freezer wall 300. For example, in some embodiments, only two air guides 310 may be provided, or more than three air guides 310 may be provided, such as four or more air guides 310 may be provided.

It should be appreciated that the overall shape and vertical depth of the one or more air guides 310 depicted is provided by way of example only. In additional exemplary embodiments, each air guide 310 may have a unique shape, for instance, each air guide 310 may have a triangular shape or a circular shape. Moreover, in additional embodiments, each air guide 310 may have a unique vertical depth, e.g., each air guide 310 may have a unique back-to-front slope, or each air guide 310 may have no back-to-front slope, such as having the same vertical depth from the back end 316 to the front end 318. For example, the air guide 310 most proximate to the left freezer wall 302 and the right freezer wall 304 may have a back-to-front slope that is greater than the back-to-front slope of the air guide 310 most proximate the center of the top freezer wall 300.

Further, the freezer chamber 160 may include a light assembly 330 that may be attached to, or provided at, the top freezer wall 300. The light assembly 330 may be positioned transversely between the front end(s) 318 of the one or more air guides 310 and the outer front edge 171 of the inner liner 166. In addition, the light assembly 330 may include a light source 332 and a light cover or light lens 334. The light source 332 may be configured to illuminate the freezer chamber 160, for instance, the light source 332 may be any suitable light source 332 that may be configured produce visible light. For example, the light source 332 may be an incandescent light bulb, a fluorescent light bulb, or a LED light source 332, such as a LED light strip. In addition, in some embodiments, the top freezer wall 300 may define a light housing 336 that may be configured to house the light source 332. For example, as depicted in phantom in FIG. 4, the light housing 336 may be a recessed housing within the top freezer wall 300 that may house the light source 332. In addition, the light housing 336 may additionally extend laterally across the top freezer wall 300, e.g., to house the light source 332 that may also extend laterally across the top freezer wall 300.

In some instances, the light source 332 may be actuatable based on commands from a controller, such as controller 150. In other instances, the light source 332 may be operated by a small lever or push-button switch that may be mounted in the freezer chamber 160, such as at the outer front edge 171 of the inner liner 166. The small lever or push-button switch may be depressed when the freezer door 102 is in the closed position and the circuit that controls the light source 332 may be interrupted. When the freezer door 102 is in the open position, such as when a user opens the freezer door 102 to access the freezer chamber 160, the switch may complete the circuit and cause the light source 332 to emanate light, e.g., illuminate the freezer chamber 160.

The light lens 334 may be attached over the light source 332 at the top freezer wall 300 and may cover the light source 332, e.g., to diffuse light that may be emanated from the light source 332, and to protect the light source 332 from the conditions, e.g., the cooled air, within the freezer chamber 160. In some embodiments, the light lens 334 may be made from a translucent material, such as but not limited to a translucent plastic. The translucent light lens 334 may diffuse, e.g., soften and redirect, the light that may be emanated from the light source 332 to reduce the glare and/or harsh shadows that may otherwise be produced by the light source 332 when illuminating the freezer chamber 160.

It should be appreciated that the light lens 334 may be attached to the top freezer wall 300 in any suitable manner. For example, the light lens 334 may include hooks that may be received by corresponding slots within the top freezer wall 300. In additional embodiments, the lights lens 334 may be coupled to the top freezer wall 300, such as mechanically coupled, to the top freezer wall 300. For instance, the light lens 334 may be coupled to the top freezer wall 300 by mechanical fasteners such as bolts and screws. Similarly, to the depicted air guides 310, the light lens 334 may include a back-to-front slope. For instance, the light lens 334 may be sloped back to front from a back portion 311 to a front portion 313 such that the front portion 313 has a greater vertical downward extension when compared to the vertical downward extension of the back portion 311. In some embodiments, the front portion 313 of the light lens 334 may have the same, or a greater, vertical downward extension than the front end(s) 318 of the one or more air guides 310.

Figure 5:
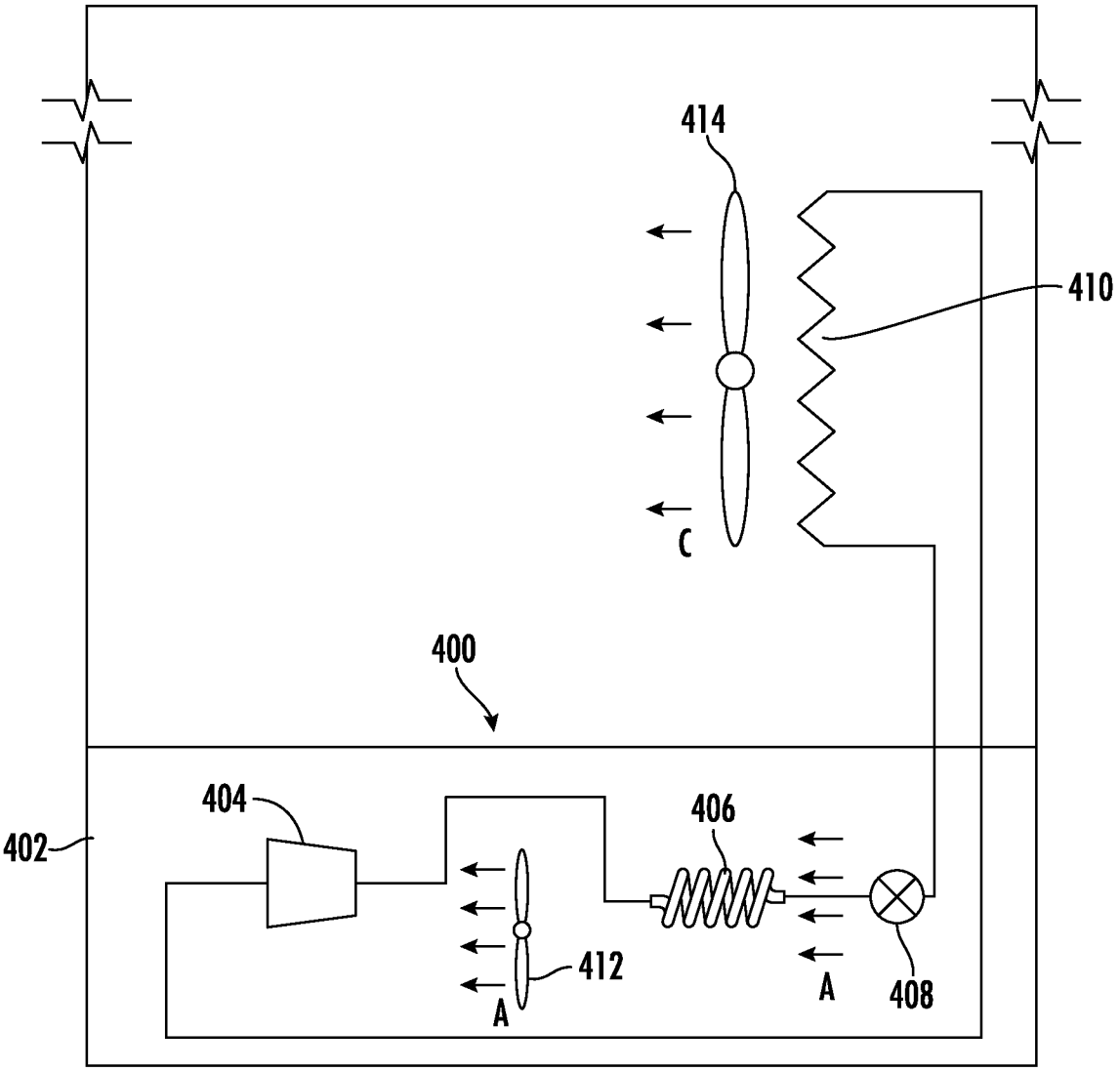
FIG. 5 provides a schematic illustration of an example sealed cooling system which may be used with a refrigerator appliance, such as the exemplary refrigerator appliance of FIG. 1, according to one or more exemplary aspects of the present subject matter.

FIG. 5 provides a schematic view of the refrigerator appliance 100, in particular the sealed cooling system 400 thereof. As illustrated in FIG. 5, refrigerator appliance 100 includes a mechanical compartment 402 that at least partially contains components for executing a known vapor compression cycle for cooling air. The components include a compressor 404, a heat exchanger or condenser 406, an expansion device 408, and an evaporator 410 connected in series and charged with a refrigerant. Evaporator 410 is also a type of heat exchanger which transfers heat from air passing over the evaporator to a refrigerant flowing through evaporator 410 thereby causing the refrigerant to vaporize. As such, cooled air C is produced and configured to cool freezer chamber 160 and fresh food chamber 162 of refrigerator appliance 100. The cooled air C may be directed to the freezer chamber 160 and fresh food chamber 162 by a fan 414.

From evaporator 410, vaporized refrigerant flows to compressor 404, which operates to increase the pressure of the refrigerant. This compression of the refrigerant raises its temperature, which is lowered by passing the gaseous refrigerant through condenser 406 where heat exchange with ambient air takes place so as to cool the refrigerant. A fan 412 is used to pull air across condenser 406, as illustrated by arrows A, so as to provide forced convection for a more rapid and efficient heat exchange between the refrigerant and the ambient air.

Expansion device 408 further reduces the pressure of refrigerant leaving condenser 406 before being fed as a liquid to evaporator 410. Collectively, the vapor compression cycle components in a refrigeration circuit, associated fans, and associated compartments are sometimes referred to as a sealed refrigeration system operable to force cold air through freezer chamber 160 and fresh food chamber 162. The refrigeration system 400 depicted in FIG. 5 is provided by way of example only. It is within the scope of the present invention for other configurations of the refrigeration system to be used as well. For example, fan 414 may be repositioned so as to pull air across evaporator 410, dual evaporators may be used with one or more fans, and numerous other configurations may be applied as well.

Figure 6:
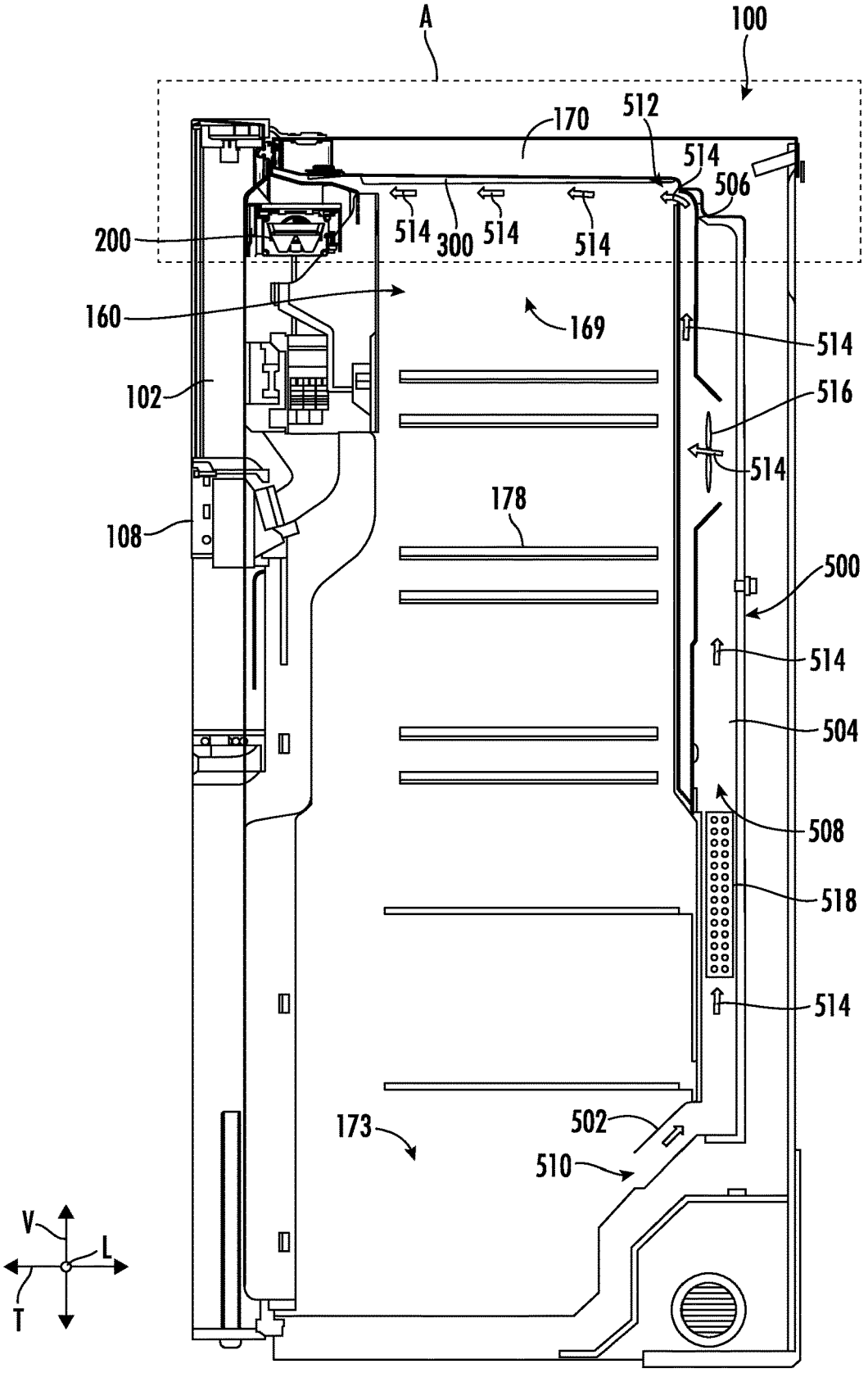
FIG. 6 provides a cross-sectional side view of the refrigerator appliance of FIG. 1 according to one or more exemplary aspects of the present subject matter.
Figure 7:
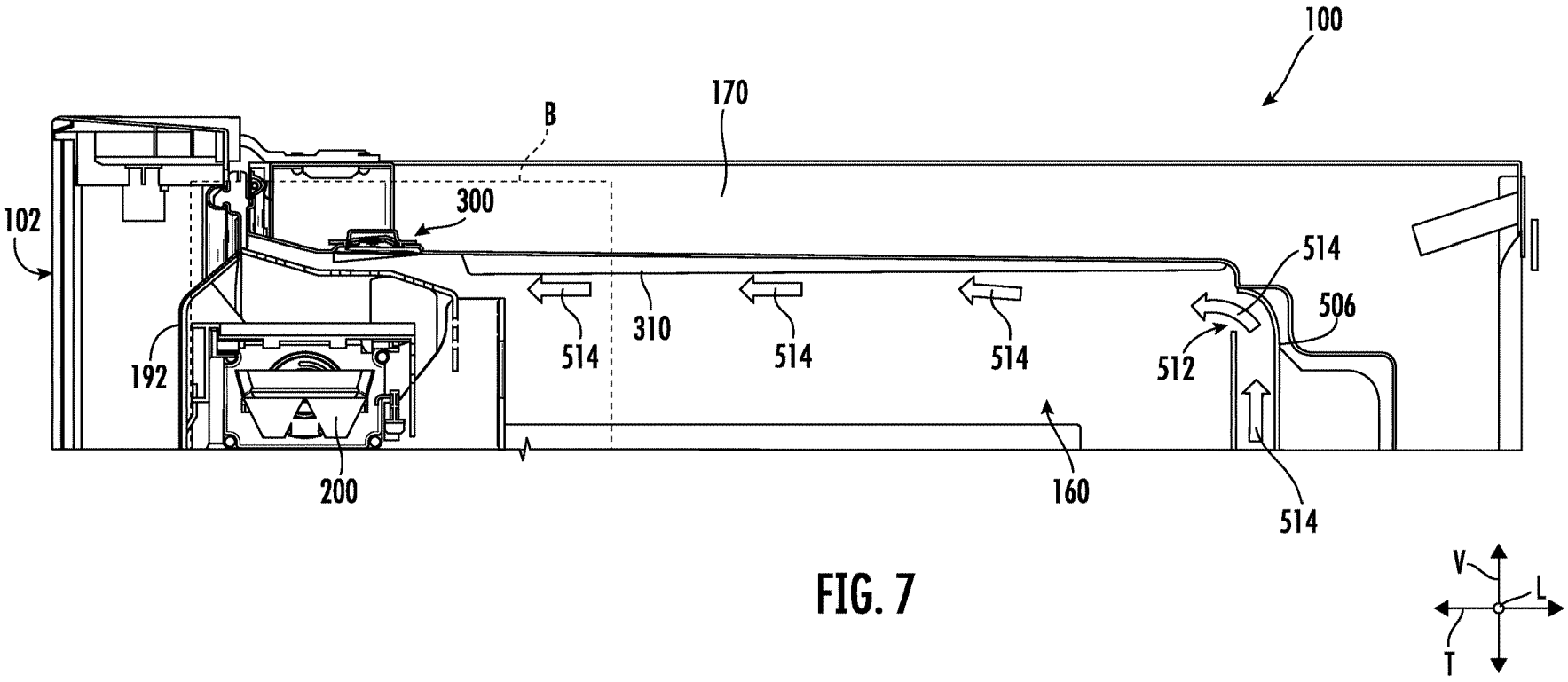
FIG. 7 provides a cross-sectional side view of the refrigerator appliance of FIG. 1 taken from section A of FIG. 6.
Figure 8:
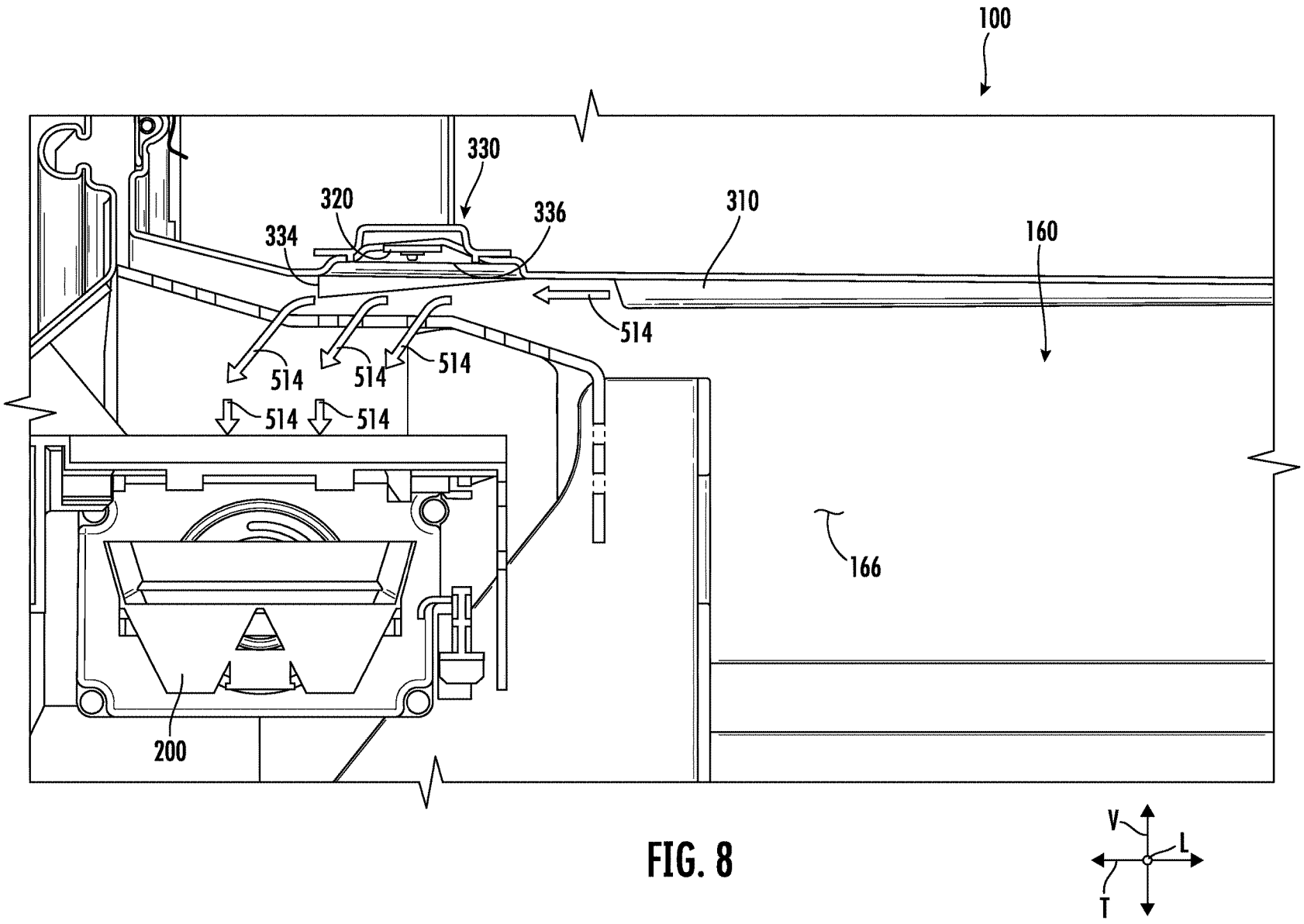
FIG. 8 provides a cross-sectional side view of the refrigerator appliance of FIG. 1 taken from section B of FIG. 7.

Referring now to FIGS. 6 through 8, cross-sectional views of the refrigerator appliance 100 according to one or more exemplary embodiments of the present subject matter are provided. FIG. 6 depicts a cross-sectional view of the refrigerator appliance 100 according to one or more exemplary aspects of the present subject matter. FIG. 7 depicts a cross-sectional view of the refrigerator appliance 100 taken from section A of FIG. 6. FIG. 8 provides a cross-sectional view of the refrigerator appliance 100 taken from section B of FIG. 7.

The refrigerator appliance 100 may include a back channel 500 that may be positioned behind the back freezer wall 306 of the freezer chamber 160, e.g., transversely behind the back freezer wall 306. In some embodiments, the back channel 500 may be, at least partially, physically separated from the freezer chamber 160, e.g., by the back freezer wall 306. In addition, the back channel 500 may include a back channel inlet passage 502 positioned at or within the bottom portion 173 of the freezer chamber 160, a back channel main passage 504 that may extend approximately parallel to the back freezer wall 306, and a back channel outlet passage 506 positioned at or within the top portion 169 of the freezer chamber 160. Together the back channel inlet passage 502, the back channel main passage 504, and the back channel outlet passage 506 may define cooled air passage 508 that may fluidly couple the bottom portion 173 of the freezer chamber 160, and the top portion 169 of the freezer chamber 160.

Moreover, in some embodiments, the back channel inlet passage 502 may define a cooled air inlet 510 and may extend vertically downward from the back channel main passage 504 and laterally into the freezer chamber 160, e.g., toward the freezer door 102, from the back channel main passage 504. As such, in some embodiments, the back channel inlet passage 502 may form an obtuse angle relative to the back channel main passage 504. In addition, the back channel outlet passage 506 may define a cooled air outlet 512 and may extend from the back channel main passage 504 to the one or more ports 308 defined through the freezer back wall 306. Further, in some instances, the back channel outlet passage 506 may be configured to direct or route air, such as a flow of cooled air 514, vertically upward toward the top freezer wall 300 and laterally outward toward the freezer door 102. For example, the back channel outlet passage 506 may be a curved passage having a radius of curvature configured to direct or route a flow of cooled air 514 vertically upward and laterally outward.

In some embodiments, the back channel 500 of the refrigerator appliance 100 may be a part of a sealed cooling system, such as the sealed cooling system 400, described in more detail with reference to FIG. 5. For instance, in some embodiments, the back channel 500 may include a fan 516 positioned within the back channel 500. The fan 516 may be configured in substantially the same manner as the fan 414 of FIG. 5. For instance, the flow of cooled air 514 may be directed into and around the freezer chamber 160 by fan 516. As depicted in FIG. 6, the flow of cooled air 514 may be forced from the bottom portion 173 of the freezer chamber 160 to the top portion 169 of the freezer chamber 160 through the cooled air passage 508, e.g., by the fan 516.

Specifically, air within the bottom portion 173 of the freezer chamber 160, e.g., ambient air within the bottom portion 173 of the freezer chamber 160, may be forced into the cooled air passage 508 at the cooled air inlet 510 and expelled from the cooled air passage 508 at the cooled air outlet 512.

For instance, in some embodiments, the fan 516 may create a vacuum in the cooled air passage 508 to create the flow of cooled air 514 within the cooled air passage 508. Specifically, air may be pulled into the cooled air passage 508 from the bottom portion 173 of the freezer chamber 160 by the rotation of the fan 516, e.g., rotation of fan blades of the fan 516. In some embodiments, the flow of cooled air 514 may be forced through the cooled air passage 508 and may be passed across an evaporator 518 positioned within the cooled air passage 508. The evaporator 518 may be configured in a substantially similar manner to the evaporator 410 depicted in FIG. 5, for instance, the evaporator 518 may be a part of a sealed cooling system, such as the sealed cooling system 400 described in more detail above. The evaporator 518 may be configured to remove heat from the flow of cooled air 514, e.g., to cool or lower the temperature of the flow of cooled air 514, such as to cool the flow of cooled air 514 to a temperature at or approximately below freezing.

One of ordinary skill in the art would recognize that evaporators are a type of heat exchanger that are commonly used in the art and that the evaporator depicted in FIG. 6 is provided by way of example only. In alternative exemplary embodiments, any suitable heat exchanger, and more particularly, any suitable evaporator may be used to remove heat from the flow of cooled air 514.

After passing over the evaporator 518, the flow of cooled air 514 may be pulled further up the cooled air passage 508 and may pass through the fan 516. After passing through the fan 516, the flow of cooled air 514 may then be pushed, e.g., by the fan 516, vertically upward to the back channel outlet passage 506 where the flow of cooled air 514 may be directed or routed into the top portion 169 of the freezer chamber 160. Specifically, as the flow of cooled air 514 passes through the back channel outlet passage 506 it may be expelled out of the back channel outlet passage 506 vertically upward toward the top freezer wall 300 and laterally outward toward the freezer door 102, e.g., as the flow of cooled air 514 follows the shape of the back channel outlet passage 506. As the flow of cooled air 514 enters the top portion 169 of the freezer chamber 160, the one or more air guides 310 may guide the flow of cooled air 514 through the one or more air channels 312.

In some instances, the one or more ports 308 defined through the back freezer wall 306 may separate the flow of cooled air 514 into multiple flows of cooled air 514. For example, when the back freezer wall 306 defines two ports 308, such as depicted in FIG. 4, the flow of cooled air 514 may be separated, such that approximately half of the flow of cooled air 514 may be guided through the two air channels 312 left of the centermost air guide 310, e.g., the air guide 310 most proximate the center of the top freezer wall 300, and that the other approximately half of the flow of cooled air 514 may be guided through the two air channels 312 right of the centermost air guide 310.

In additional embodiments, the number of ports 308 defined through the back freezer wall 306 may correspond with the number of air channels 312 defined by the one or more air guides 310. For instance, in some embodiments, the number of ports 308 may be equal to the number of air channels 312 defined at the top freezer wall 300. For example, the back freezer wall 306 may include four ports 308 that are configured to separate the flow of cooled air 514 to four air channels 312 defined at the top freezer wall 300. Each of the separated flows of cooled air 514 may be contained within a respective air channel 312 defined at the top freezer wall 300. Each flow of cooled air 514 may then be directed or routed toward the ice making assembly 200 by the respective air channel 312.

Further, after exiting the respective air channels 312, the flow(s) of cooled air 514 may then be directed or routed toward the ice making assembly 200 by the light assembly 330. For instance, as depicted in FIG. 8, the flow of cooled air 514 that has been directed or routed through the air channel(s) 312 may be directed or routed into the ice making assembly 200 by the light lens 334, e.g., the flow(s) of cooled air 514 may pass across the back-to-front sloped surface of the light lens 334 and may thereby be directed or routed vertically downward and laterally forward such that the flow(s) of cooled air 514 are redirected toward the ice making assembly 200.

Specifically, the light lens 334 may guide the flow(s) of cooled air 514 into the guided cooled air inlet 194 (see e.g., FIG. 2) defined at the top edge of the ice making chamber 192. The flow(s) of cooled air 514 that may be directed or routed into the ice making assembly 190 may be used to cool the ice making assembly 190, e.g., the components of the ice making assembly 190, by cooling the ambient air within the ice making assembly, e.g., cooling the ambient air surrounding the components of the ice making assembly 190, such as to a temperature at approximately the freezing point of water or below the freezing point of water. For example, the flow(s) of cooled air 514 may cool the ice maker 200 or components thereof, e.g., the mold body 210, an ice compartment that may be configured to hold harvested ice, etc.

Embodiments of the refrigerator appliance 100 provided herein may advantageously provide improved air flow communication between the sealed cooling system 400 and the ice making assembly 190. For instance, by adding the air guides 310, the potential for an unobstructed flow of cooled air 514 to reach the ice maker 200 is increased as the air guides 310 may limit the possibility of a user obstructing or blocking the flow of cooled air 514. In addition, the improved air flow communication between the sealed cooling system 400 and the ice making assembly 190 may allow for increased efficiency of the ice making assembly 190 as the ice making assembly 190 may not require as much energy to directly cool the ice making assembly, e.g., through refrigerant line 228.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a freezer chamber having a freezer door mounted thereto to selectively move between an open position and a closed position, the freezer chamber comprising an inner liner extending along the vertical direction from a bottom freezer wall to a top freezer wall and extending along the transverse direction between an outer front edge to a back freezer wall;

an ice making assembly positioned at the freezer door of the refrigerator appliance, the ice making assembly comprising an ice making chamber and an ice maker housed within the ice making chamber; and one or more air guides, each air guide being directly attached to the top freezer wall and protruded into the freezer chamber from the top freezer wall, each air guide of the one or more air guides extending from a first end to a second end, the one or more air guides each defining, at least in part, one or more air channels at the top freezer wall.

2. The refrigerator appliance of claim 1, wherein the first end of each air guide is positioned approximately at an intersection of the top freezer wall and the back freezer wall, and wherein the second end of each air guide is positioned proximate the outer front edge of the inner liner.

3. The refrigerator appliance of claim 1, wherein each air guide is tapered from the first end to the second end, wherein a vertical downward extension of each tapered air guide increases from the first end to the second end.

4. The refrigerator appliance of claim 1, wherein the one or more air guides comprises two or more air guides, and wherein a lateral side of an air guide of the two or more air guides and an adjacent lateral side of an adjacent air guide of the two or more air guides together define an air channel.

5. The refrigerator appliance of claim 1, further comprising:

a light assembly attached to the top freezer wall, wherein the inner liner extends along the lateral direction from a left freezer wall to a right freezer wall, wherein the light assembly extends along the lateral direction between the left freezer wall and the right freezer wall, and wherein the light assembly is positioned between the front ends of the one or more air guides and the outer edge of the inner liner with respect to the transverse direction.

6. The refrigerator appliance of claim 5, wherein the light assembly comprises a light source that is covered by a light lens, wherein the light lens comprises a back portion and front portion, wherein the light lens extends vertically downward into the freezer chamber, and wherein the vertical downward extension of the front portion is greater than the vertical downward extension of the back portion.

7. The refrigerator appliance of claim 1, wherein the ice maker is ambiently exposed within the freezer chamber when the freezer door is in the closed position.

8. The refrigerator appliance of claim 1, further comprising:

a back channel positioned transversely behind the back freezer wall, the back channel defining a cooled air passage, and wherein a bottom portion of the freezer chamber and a top portion of the freezer chamber are fluidly coupled by the cooled air passage.

9. The refrigerator appliance of claim 8, further comprising:

a sealed cooling system comprising a fan positioned within the cooled air passage, wherein the back channel defines a cooled air inlet in fluid communication with the bottom portion of the freezer chamber and a cooled air outlet in fluid communication with the top portion of the freezer chamber, and wherein the fan is configured to produce a flow of cooled air within the cooled air passage.

10. The refrigerator appliance of claim 9, wherein the refrigerator appliance is configured such that during operation of the refrigerator appliance, the produced flow of cooled air is expelled into the top portion of the freezer chamber, and wherein the flow of cooled air within the top portion of the freezer chamber is guided by the one or more air guides through the one or more air channels toward the ice making assembly.

11. The refrigerator appliance of claim 10, wherein a light lens is attached to the top freezer wall, wherein the ice making assembly comprises a guided cold air inlet defined at a top edge of the ice making chamber, and wherein the refrigerator appliance is configured such that the flow of cooled air is directed into the guided cold air inlet by the light lens.

* * * * *